US007196670B2

(12) United States Patent
Chen

(10) Patent No.: US 7,196,670 B2
(45) Date of Patent: Mar. 27, 2007

(54) ANTENNA RING FOR ELECTRONIC DEVICE

(76) Inventor: Franklin F K Chen, 6007 Johnston Dr., Oakland, CA (US) 94611

( * ) Notice: Subject to any disclaimer, the term of this patent is extended or adjusted under 35 U.S.C. 154(b) by 0 days.

(21) Appl. No.: 11/162,051

(22) Filed: Aug. 26, 2005

(65) Prior Publication Data

US 2006/0273963 A1 Dec. 7, 2006

Related U.S. Application Data

(60) Provisional application No. 60/686,623, filed on Jun. 3, 2005.

(51) Int. Cl.
*H01Q 1/24* (2006.01)

(52) U.S. Cl. ..... 343/702; 224/271

(58) Field of Classification Search ..... 343/702, 343/718, 741, 866; 224/197, 269, 271
See application file for complete search history.

(56) References Cited

U.S. PATENT DOCUMENTS

| | | | |
|---|---|---|---|
| 5,265,158 | A | 11/1993 | Tattari |
| 5,697,071 | A | 12/1997 | Fan |
| 5,850,954 | A | 12/1998 | Dong-Joo |
| 5,893,497 | A | 4/1999 | Schaiewitz |
| 6,176,401 | B1 | 1/2001 | Lim |
| 6,206,257 | B1 | 3/2001 | Peele et al. |
| 6,283,348 | B1 | 9/2001 | Wang |
| 6,286,737 | B1 | 9/2001 | Whitley |
| 6,299,041 | B1 | 10/2001 | Pitisi et al. |
| 6,305,588 | B1 | 10/2001 | Michel et al. |
| 6,318,610 | B1 | 11/2001 | Doherty |
| 6,357,646 | B1 | 3/2002 | Gur et al. |
| 6,364,184 | B1 | 4/2002 | Hauck et al. |
| 6,405,910 | B1 | 6/2002 | Infanti et al. |
| 6,443,340 | B1 | 9/2002 | Chung et al. |
| 6,443,343 | B2 | 9/2002 | Kamiya |
| 6,513,201 | B2 | 2/2003 | Beune et al. |
| 6,550,655 | B2 | 4/2003 | Warner |
| 6,568,576 | B1 | 5/2003 | Godshaw et al. |
| 6,626,336 | B1 | 9/2003 | Shindou et al. |
| 6,679,406 | B2 | 1/2004 | Sakai et al. |
| 6,742,685 | B2 | 6/2004 | Williams |
| 6,786,372 | B2 | 9/2004 | Enkerlin et al. |

(Continued)

FOREIGN PATENT DOCUMENTS

WO WO 04033309 A2 4/2004

OTHER PUBLICATIONS

Jose Dees, International Search Report, PCT/US05/31564, Nov. 29, 2006, USPTO ISA, USA.

(Continued)

*Primary Examiner*—Tan Ho
(74) *Attorney, Agent, or Firm*—Squire, Sanders & Dempsey; Aaron Wininger

(57) ABSTRACT

An accessory for an electronic device, such as a mobile phone, includes a mounting portion and a coupling portion. The mounting portion is adapted for mounting to an antenna region of the electronic device. The coupling portion is coupled to the mounting portion and adapted for detachable coupling to an object to thereby couple the electronic device to the object.

28 Claims, 2 Drawing Sheets

U.S. PATENT DOCUMENTS

| | | | | |
|---|---|---|---|---|
| 6,892,880 | B2 | 5/2005 | Nieves | |
| 2002/0016188 | A1* | 2/2002 | Kashiwamura | 455/568 |
| 2006/0030360 | A1* | 2/2006 | Yeh | 455/557 |
| 2006/0150375 | A1* | 7/2006 | Moore | 24/299 |

OTHER PUBLICATIONS

Jose Dees, Written Opinion, PCT/US05/31564, Nov. 29, 2006, USPTO ISA, USA.

* cited by examiner

ANTENNA RING FOR ELECTRONIC DEVICE

PRIORITY REFERENCE TO PRIOR APPLICATION

This application claims benefit of and incorporates by reference patent application Ser. No. 60/686,623, entitled "Cell Ring," filed on Jun. 3, 2005, by inventor Franklin F K Chen.

TECHNICAL FIELD

This invention relates generally to electronics, and more particularly, but not exclusively, provides a ring or clasp with an embedded antenna or for covering an antenna of an electronic device, such as a mobile phone, global positioning satellite (GPS) device, personal digital assistant (PDA) or radio.

BACKGROUND

Electronic devices, such as mobile phones, are easily lost as they are small and are often placed in pockets or purses where they are not secured or tethered. Accordingly, the devices can easily be misplaced or fall out.

One solution is to use clip-on mechanisms attached to the side of a device to couple the electronic device to a belt or other article of clothing. However, clip-on mechanisms, when integral with the device, make the device bulky.

Accordingly, a new non-bulky device is needed to enable the coupling of an electronic device to an object.

SUMMARY

Embodiments of the invention provide an accessory for an electronic device such as a mobile phone, PDA, etc. The accessory comprises a mounting portion adapted for mounting to an antenna region of the electronic device; and a coupling portion coupled to the mounting portion and adapted for detachable coupling to an object to thereby couple of the electronic device to the object. In an embodiment of the invention, the accessory is adapted for acting as an antenna for the electronic device; the antenna can be embedded within the accessory or a portion of the accessory (e.g., into the coupling portion).

In one embodiment, the mounting portion has insertion region adapted for insertion into an antenna socket defined in the antenna region of the electronic device. The insertion region can be threaded to permit threadable coupling to a corresponding threaded area of the antenna socket or can be adapted for frictionally engaging at least a portion of the antenna socket when the insertion region is inserted into the antenna socket to frictionally couple the insertion region to the electronic device. Also, the mounting portion includes a bore adapted for receiving by insertion therein an antenna extending from the antenna region of the electronic device. The bore of the mounting portion can be adapted for frictionally engaging at least portion of the antenna inserted into the bore to frictionally couple the antenna to the mounting portion.

In an embodiment of the invention, the accessory can further comprise a rotational coupling interposed between the coupling portion and the mounting portion to permit rotation of the coupling portion with respect to the mounting portion about an axis extending through the rotational coupling.

In an embodiment of the invention, the coupling portion comprises a hook. The hook can define a space sufficiently sized to permit extension therein of a finger of a user. A latch can also pivotally coupled to a root area of the hook proximate the mounting portion and extending between the root area and a free end of the hook. The latch can be biased in a direction to close a break defined between the root area and free end of the hook.

In an embodiment of the invention, the coupling portion comprises a clasp. The clasp can define a space sufficiently sized to permit extension therein of a finger of a user. The clasp can have a deflecting portion extending across a break defined in the clasp and biased in a first direction to close the break, the clasp further including a lever adapted for permitting a user to deflect the deflecting portion in a second direction opposite the first direction and thereby expose the break. The lever and deflecting portion can be located on opposite sides of the mounting portion. In another embodiment, the lever and deflecting portion can be located on a common side of the mounting portion.

In an embodiment of the invention, the coupling portion comprises a generally D-shaped ring having an arcuate member having a first end pivotally coupled to an elongated portion member, the arcuate portion being biased in a direction to urge a second end of the arcuate member towards the elongated portion. The D-shaped ring can define a space sufficiently sized to permit extension therein of a finger of a user.

In an embodiment of the invention, the coupling portion comprises a generally rectangular shaped ring having a three sided member having a first end pivotally coupled to the single sided member, the three sided member being biased in a direction to urge a second end of the three sided member towards the single sided member.

Embodiments of the invention also provide a method comprising providing the accessory described above and operating the coupling portion to couple it to an object.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

The following description is provided to enable any person having ordinary skill in the art to make and use the invention, and is provided in the context of a particular application and its requirements. Various modifications to the embodiments will be readily apparent to those skilled in the art, and the principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1:
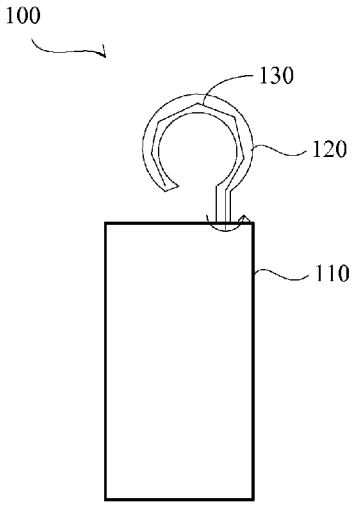
FIG. 1 is a diagram illustrating an electronic device having a circular ring.

FIG. 1 is a diagram illustrating an electronic device 100 having a circular ring (also referred to as a hook) 120. The device 100 comprises an electronics section 110 coupled to the ring 120. In one embodiment, the ring 120 has an articulated connection to the electronics section 110, enabling the ring 120 to rotate. The electronics section 110 can include a radio, GPS device, mobile phone, PDA or other device requiring an antenna. The antenna can be located within the electronics section 110 or integral with the ring 120 (e.g., the ring 120 may include an antenna 130 embedded therein).

The ring 120 can be located where an external antenna would normally be coupled to the electronics section 110, such as in the upper right or left hand corner of the electronics section 110. The ring 120 is approximately circular in shape with an inner diameter of about 0.5 inches to about 1 inch. In one embodiment, the ring 120 has an inner diameter large enough to loop around a bearer's index finger. The ring 120 can form an antenna or have an antenna within the ring 120. In an embodiment in which the antenna is embedded within the ring 120, the antenna can have a length equal to the circumference of the ring 120 (e.g., to form a loop antenna) or a length less than the circumference of the ring 120. The antenna is coupled to circuitry within the electronics section 110.

The ring 120 can be made from one or more materials, such as injection molded plastic, lightweight metals, and/or decorative metals, etc. to form a rigid structure. Accordingly, the ring 120 enables the device 100 to be hooked onto the bearer's clothing (such as belt loops and pockets), or straps/rings (such as those of a shoulder bag and backpacks). The device 100 also affords the bearer a more secure grip with a finger through the ring shaped structure of embodiments of the invention. The ring 120 also enables the bearer to twirl the device 100 around the bearer's finger.

Figure 2A:
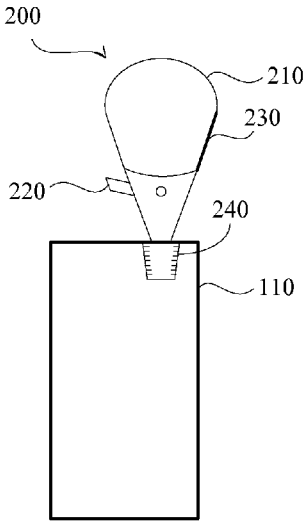
FIGS. 2A and 2B are diagrams illustrating an electronic device having a ring shaped clasp.
Figure 2B:
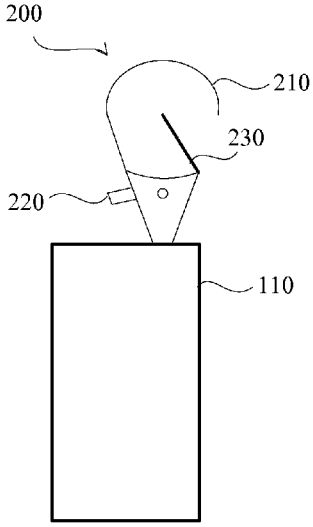

FIGS. 2A and 2B are diagrams illustrating an electronic device 200 having a ring shaped clasp 210. The clasp 210 is substantially similar to the ring 120 except that the clasp 210 is spring loaded and is normally in a closed position as shown in FIG. 2A. The clasp 210 has a lever 220 that opens the clasp 210. The clasp 210 opens by the bearer's pushing the lever 220, which opens the clasp by deflecting an arm 230 that forms a portion of the clasp 210. Accordingly, this embodiment enables the bearer to open the clasp 210 to attach/detach the device 200 to/from the bearer's clothing or accessories.

The clasp 210 can be coupled to the electronics section 110 via a threaded attachment, adhesive, or other technique. In an embodiment of the invention, the clasp 210 can be manufactured with the electronics section 110 in a single piece.

Figure 3A:
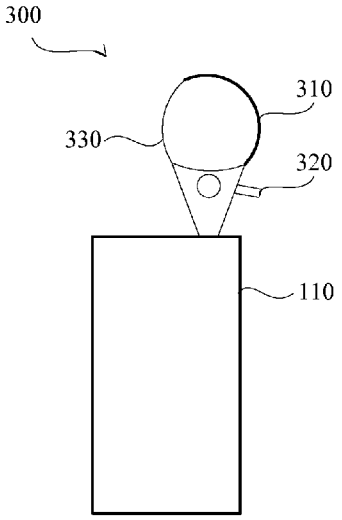
FIGS. 3A and 3B are diagrams illustrating an electronic device having a ring shaped clasp according to another embodiment.
Figure 3B:
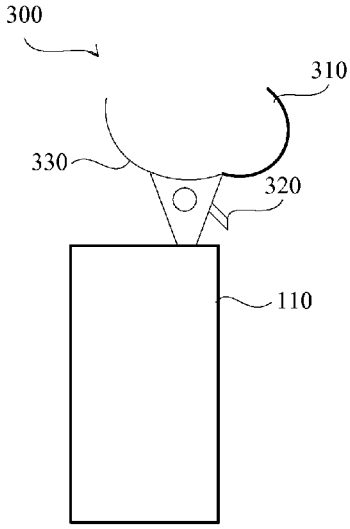

FIGS. 3A and 3B are diagrams illustrating an electronic device 300 having a ring shaped clasp according to another embodiment. The clasp is formed by two arms 310 and 330 that are both coupled to a lever 320 such that activation of the lever 320 causes the opening of the clasp via movement of both arms 310 and 330.

Figure 4:
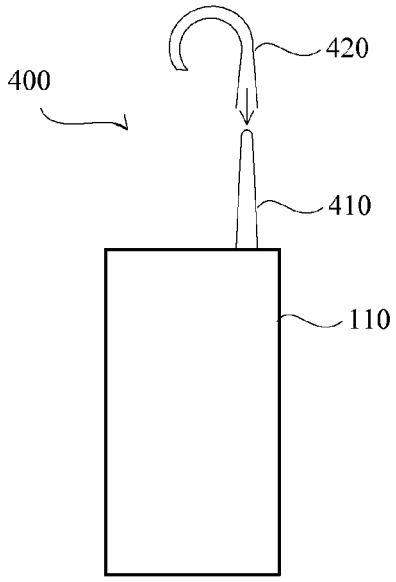
FIG. 4 is a diagram illustrating an electronic device and a ring capable of being coupled to an antenna of the device.

FIG. 4 is a diagram illustrating an electronic device 400 and a ring 420 capable of being coupled to an antenna 410 of the device. The ring 420 fits snugly over the antenna 410 via a friction fit, adhesive, threaded attachment or other technique. The ring 420 can act as antenna booster to enhance the sending and/or receiving of signals from the antenna 410.

Figure 5:
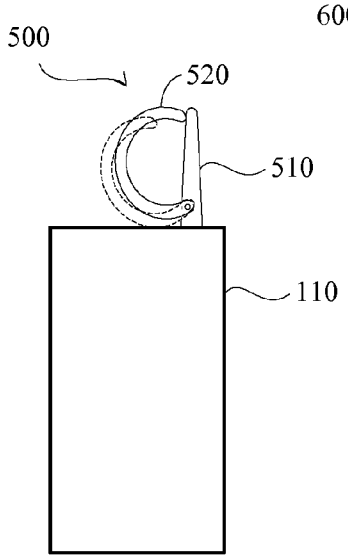
FIG. 5 is a diagram illustrating an electronic device having a D-shaped clasp according to another embodiment of the invention.

FIG. 5 is a diagram illustrating an electronic device 500 having a D-shaped clasp 520 according to another embodiment of the invention. The clasp 520 is coupled to a base of an antenna 510 via a pivot mechanism and is spring loaded such that the clasp 520 is normally in a closed position. The clasp 520 is opened by the bearer's squeezing or pushing on the clasp 520 near the pivot mechanism. This embodiment allows a user to approximate a pistol hold on the electronic device 500. This embodiment enables the bearer to open the clasp 520 to attach/detach the electronic device 500 to/from the bearer's clothing or accessories.

Figure 6:
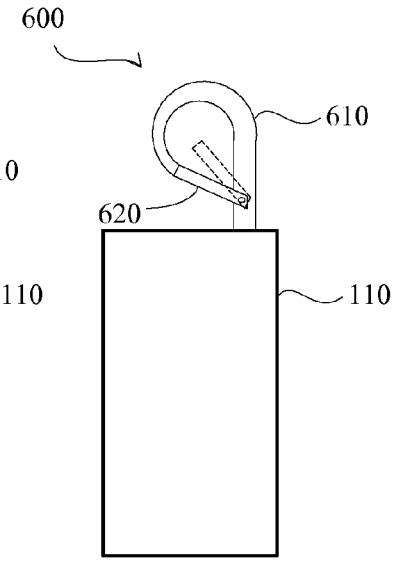
FIG. 6 is a diagram illustrating an electronic device having an oval shaped clasp according to another embodiment of the invention.

FIG. 6 is a diagram illustrating an electronic device 600 having an oval shaped clasp 610 according to another embodiment of the invention. The clasp 610 includes an antenna and arm 620 that is pivotly coupled to a base of the antenna, such that pushing against the arm 620 places it in an open position. The arm 620 is spring loaded so that it is normally in a closed position.

The foregoing description of the illustrated embodiments of the present invention is by way of example only, and other variations and modifications of the above-described embodiments and methods are possible in light of the foregoing teaching. For example, many of the features described in the above embodiments are interchangeable between embodiment. Further, components of this invention may be implemented using a programmed general purpose digital computer, using application specific integrated circuits, or using a network of interconnected conventional components and circuits. Connections may be wired, wireless, modem, etc. The embodiments described herein are not intended to be exhaustive or limiting. The present invention is limited only by the following claims.

What is claimed is:

1. An accessory for an electronic device, comprising:

a mounting portion adapted for mounting to an antenna region of the electronic device;

a coupling portion coupled to the mounting portion and adapted for detachable coupling to an object to thereby couple the electronic device to the object; and a rotational coupling interposed between the coupling portion and the mounting portion to permit rotation of the coupling portion with respect to the mounting portion about an axis extending through the rotational coupling.

2. The accessory of claim 1, wherein the accessory is adapted for acting as an antenna for the electronic device.

3. The accessory of claim 1, further comprising an antenna embedded therein, the antenna being adapted for electrically coupling to the electronic device when the mounting portion is mounted to the antenna region of electronic device.

4. The accessory of claim 3, wherein at least a portion of the antenna extends into the coupling portion.

5. The accessory of claim 1, wherein the mounting portion has insertion region adapted for insertion into an antenna socket defined in the antenna region of the electronic device.

6. The accessory of claim 5, wherein the insertion region is threaded to permit threadable coupling to a corresponding threaded area of the antenna socket.

7. The accessory of claim 5, wherein the insertion region is adapted for frictionally engaging at least a portion of the antenna socket when the insertion region is inserted into the antenna socket to frictionally couple the insertion region to the electronic device.

8. The accessory of claim 1, wherein the mounting portion includes a bore adapted for receiving by insertion therein an antenna extending from the antenna region of the electronic device.

9. The accessory of claim 8, wherein the bore of the mounting portion is adapted for frictionally engaging at least portion of the antenna inserted into the bore to frictionally couple the antenna to the mounting portion.

10. The accessory of claim 1, wherein the coupling portion comprises a hook.

11. The accessory of claim 10, wherein the hook defines a space sufficiently sized to permit extension therein of a finger of a user.

12. The accessory of claim 10, wherein the hook defines a space minimally sized to permit the hook to hook around a key ring or belt loop.

13. The accessory of claim 10, further comprising a latch pivotally coupled to a root area of the hook proximate the mounting portion and extending between the root area and a free end of the hook.

14. The accessory of claim 13, wherein the latch is biased in a direction to close a break defined between the root area and free end of the hook.

15. The accessory of claim 1, wherein the coupling portion comprises a clasp.

16. The accessory of claim 15, wherein the clasp defines a space sufficiently sized to permit extension therein of a finger of a user.

17. The accessory of claim 15, wherein the clasp defines a space minimally sized to permit the clasp to hook around a key ring or bell loop.

18. The accessory of claim 15, wherein the clasp has a deflecting portion extending across a break defined in the clasp and biased in a first direction to close the break, the clasp further including a lever adapted for permitting a user to deflect the deflecting portion in a second direction opposite the first direction and thereby expose the break.

19. The accessory of claim 1, wherein the coupling portion comprises a generally D-shaped ring having an arcuate member having a first end pivotally coupled to an elongated member, the arcuate member being biased in a direction to urge a second end of the arcuate member towards the elongated member.

20. The accessory of claim 19, wherein the D-shaped ring defines a space sufficiently sized to pennit extension therein a finger of a user.

21. The accessory of claim 19, wherein the D-shaped ring defines a space minimally sized to permit the D-shaped ring to hook around a key ring or belt loop.

22. An electronic device incorporating the accessory of claim 1.

23. A method, comprising:

providing the accessory of claim 1; and operating the coupling portion to couple the accessory to an object.

24. An accessory for an electronic device, comprising:

a mounting portion adapted for mounting to an antenna region of the electronic device; and a coupling portion coupled to the mounting portion and adapted for detachable coupling to an object to thereby couple the electronic device to the object;

wherein the coupling portion comprises a clasp;

wherein the clasp has a deflecting portion extending across a break defined in the clasp and biased in a first direction to close the break, the clasp further including a lever adapted for permitting a user to deflect the deflecting portion in a second direction opposite the first direction and thereby expose the break;

wherein the lever and deflecting portion are located on opposite sides of the mounting portion.

25. An accessory for an electronic device, comprising:

a mounting portion adapted for mounting to an antenna region of the electronic device; and a coupling portion coupled to the mounting portion and adapted for detachable coupling to an object to thereby couple the electronic device to the object;

wherein the coupling portion comprises a clasp;

wherein the clasp has a deflecting portion extending across a break defined in the clasp and biased in a first direction to close the break, the clasp further including a lever adapted for permitting a user to deflect the deflecting portion in a second direction opposite the first direction and thereby expose the break;

wherein the lever and deflecting portion are located on a common side of the mounting portion.

26. An accessory for an electronic device, comprising:

a mounting portion adapted for mounting to an antenna region of the electronic device; and a coupling portion coupled to the mounting portion and adapted for detachable coupling to an object to thereby couple the electronic device to the object;

wherein the coupling portion comprises a generally rectangular shaped ring having a three sided member having a first end pivotally coupled to the single sided member, the three sided member being biased in a direction to urge a second end of the three sided member towards the single sided member.

27. The accessory of claim 26, wherein the rectangular shaped ring defines a space sufficiently sized to permit extension therein a finger of a user.

28. The accessory of claim 26, wherein the rectangular shaped ring defines a space minimally sized to permit the rectangular shaped ring to hook around a key ring or belt loop.

* * * * *